United States Patent [19]

Yoshida et al.

[11] Patent Number: 4,862,706

[45] Date of Patent: Sep. 5, 1989

[54] ICE MAKING MACHINE

[75] Inventors: Kazuhiro Yoshida; Hideji Ohta, both of Toyoake, Japan

[73] Assignee: Hoshizaki Electric Co., Ltd., Aichi, Japan

[21] Appl. No.: 255,266

[22] Filed: Oct. 11, 1988

[51] Int. Cl.[4] ..... F25C 5/04

[52] U.S. Cl. ..... 62/347; 62/349

[58] Field of Search ..... 62/347, 349, 71, 74

[56] References Cited

U.S. PATENT DOCUMENTS

| | | | |
|---|---|---|---|
| 3,190,083 | 6/1965 | Miller | 62/349 |
| 3,246,481 | 4/1966 | Douglas et al. | 62/347 X |
| 4,601,176 | 7/1986 | Suyama | 62/347 X |
| 4,617,806 | 10/1986 | Sakai | 62/347 |

*Primary Examiner*—William E. Tapolcai

*Attorney, Agent, or Firm*—Wenderoth, Lind & Ponack

[57] ABSTRACT

An ice making machine comprises an ice forming plate having an ice forming surface formed with a plurality of convex portions to define ice forming regions between adajcent ones of the convex portions, a water distributor having a plurality of orifices for spraying deicing water over the surface of the ice forming plate opposite the ice forming surface to remove ice produced on the ice forming regions, and a pair of supporting members connected to the ice forming plate at both lateral ends thereof. V-shaped gaps are present between the supporting members and the lateral ends of the ice forming plate, where unwanted ice grows. The water distributor is provided with, in addition to the deicing water spray orifices, auxiliary water spray orifices for directing the deicing water to the junctions between the supporting members and the ends of the ice forming plate and/or the V-shaped gaps themselves.

6 Claims, 2 Drawing Sheets

ICE MAKING MACHINE

BACKGROUND OF THE INVENTION

1. Field of the Invention

The present invention relates generally to an ice making machine and more particularly to the type of ice making machine which includes an ice forming plate formed with a plurality of protrusions laterally spaced from one another and extending vertically in the direction along which icing water (i.e. water to be frozen to ice) flows.

2. Description of the Prior Art

In an ice making machine of the type mentioned above, a pair of vertically extending ice forming plates 1 are generally disposed in opposition to each other with an evaporator 2 being interposed therebetween, as is shown in FIGS. 3 and 4 of the accompanying drawings. During the ice making or forming operation, a coolant is forced to flow through the evaporator 2 while the icing water to be frozen to ice is fed from a icing water distributor (not shown) disposed above the ice forming plates 1 and flows downwardly along the surfaces thereo between vertical protrusions 3, whereby ice pellets 6 are formed on the surfaces of the ice forming plates 1. When the ice pellets 6 thus formed have grown to a predetermined size, as detected by appropriate known detecting means, the ice making machine is changed over to an ice removing or deicing operation. During the deicing operation, a hot gas is supplied to flow through the evaporator 2 while deicing water is sprayed over the rear or inner surfaces of the ice forming plates 1 from spray nozzle orifices 5 formed in a water distributor 9. Consequently, those portions of the ice pellets 6 which are in contact with the outer surfaces of the ice forming plates 1 melt due to the heat and the pellets 6 fall into an ice storage box (not shown).

The ice forming plates 1 are secured at both lateral ends 7 thereof to brackets 4, respectively. As a result, grooves 10 having a V-shaped cross-section are formed between the bracket 4 and the ice forming plates 1, as shown in FIG. 4. Accordingly, as will be readily understood by those skilled in the art, the icing water flowing downwardly over the surface of ice being formed on the leftmost region is likely to migrate beyond the leftmost protrusion 3 (as viewed in FIG. 4) into the grooves 10 as the ice pellets 6 grow during the course of the ice making operation, whereby ice 8 is also formed in the grooves 10.

During the ice removing operation, deicing water is sprayed over the ice forming plates. It is however noted that the deicing water is fed to the rear or inner surfaces rather than the outer surfaces of the ice forming plates, and flows downwardly at middle portions of the regions defined between the protrusions 3. Consequently, little heat is transmitted from the deicing water to the portions of the ice forming plates which define the grooves 10. As a result, the ice 8 will remain unremoved even after the deicing cycle. Accordingly, upon the start of a succeeding ice making operation, the ice 8 remaining within the groove 10 will further grow to such an extent that the ice 8 is joined to the adjacent ice 6. Thus, in the succeeding deicing operation, not only ice 8 but also the ice pellets 6 in the leftmost rows located adjacent to the grooves 10 tend to remain on the ice forming plates 1. Even if the ice 8 and/or ice pellets 6 of the leftmost row (as viewed in FIG. 4) joined thereto could be released from the ice forming plates during the deicing operation, ice pellets having an undesirable shape will then be stored within the ice storage box.

Additionally, when the ice grows within the V-shape groove 10, the bracket 4 and the leftmost protrusion 3 tend to be separated from each other, causing deformation of the ice forming plates 1. This results in the ice forming plates becoming detached fro the evaporator 2, which in turn means that the ice making capability of the machine is drastically lowered and the removal of the ice pellets becomes practically impossible in extreme cases.

It is further noted that when the ice remains on the ice forming plates at the beginning of the ice making operation, the load for refrigeration is small, resulting in an increase in the amount of liquid phase coolant recirculated back to the compressor, which then has to bear a correspondingly increased load. This means that the compressor is more likely to fail.

SUMMARY OF THE INVENTION

It is therefore an object of the present invention to provide an ice making machine, in which no ice can remain in V-shaped grooves adjacent the ends of an ice forming plate at the time when the ice making machine is changed over from the deicing operation to the ice forming operation.

With the above object in view, the present invention provides an ice making machine which comprises an ice forming plate disposed substantially vertically and having an ice forming surface provided with a plurality of vertically extending convex portions which are laterally spaced from one another, thereby defining ice forming regions between adjacent ones of the convex portions, an evaporator disposed in contact with the other surface of the ice forming plate, i.e. located on the side opposite to the ice forming surface, a water distributor disposed above the ice forming plate and having a plurality of deicing water spraying orifices formed in a row for supplying deicing water over the other surface of the ice forming plate for removing ice formed on the ice forming regions, and a pair of supporting members connected to the ice forming plate at both lateral ends thereof. Grooves or gaps each having substantially V-shaped cross-section are present between the supporting members and the lateral ends of the ice forming plate on the ice forming surface, allowing ice to grow within the groove in the course of the ice making operation. According to the present invention, the water distributor is provided with, in addition to the deicing water spray orifices which supply water to deice the ice forming regions, auxiliary water spray orifices so disposed as to direct the deicing water to the junctions between the ends of the ice forming plate and the supporting members and/or the grooves or gaps.

BRIEF DESCRIPTION OF THE DRAWINGS

A preferred embodiment of the present invention will now be described, by way of example, with reference to the accompanying drawings, in which.

DESCRIPTION OF THE PREFERRED EMBODIMENT

Figure 1:
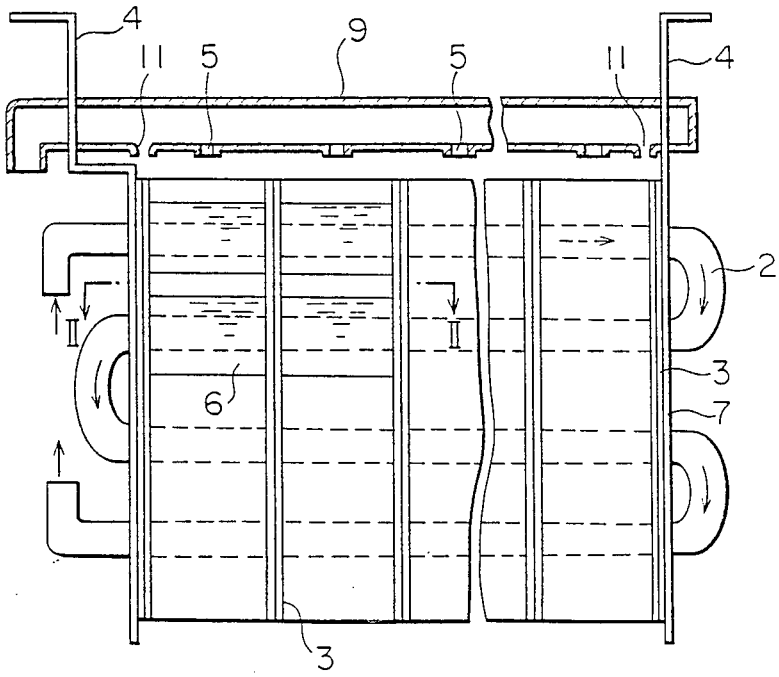
FIG. 1 is a side view in partial section of an ice making machine according to the embodiment of the invention.

The invention will be described in detail in conjunction with the preferred embodiment by reference to FIGS. 1 and 2 in which like reference numerals designate like or corresponding parts.

Figure 2:
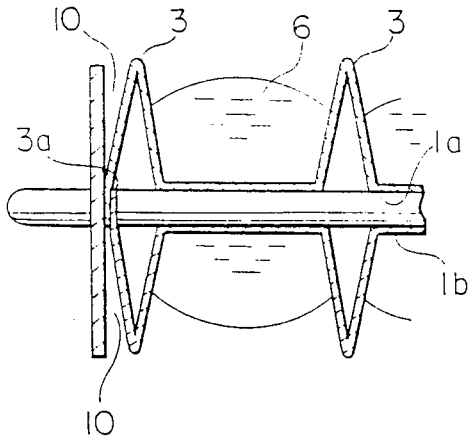
FIG. 2 is a fragmentary sectional view taken along the line II—II in FIG. 1.
Figure 3:
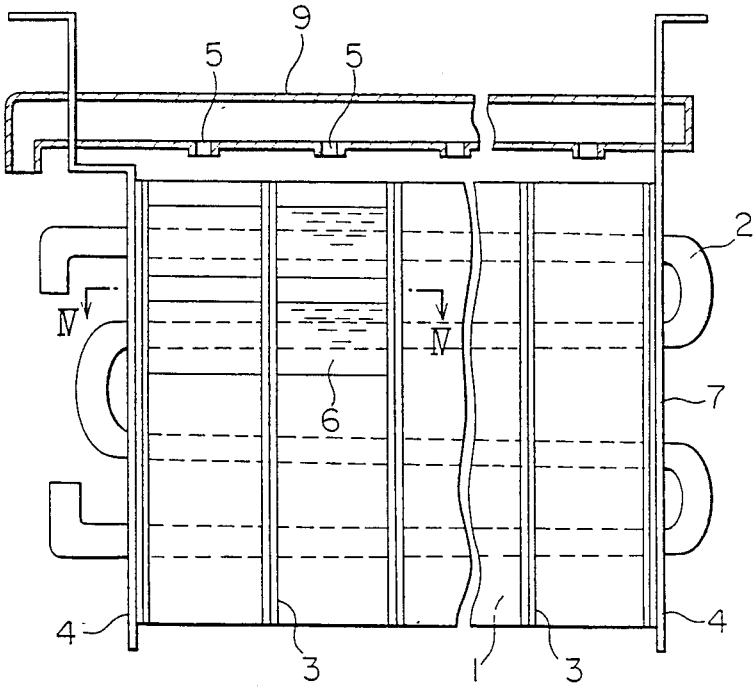
FIG. 3 (PRIOR ART)
FIG. 3 is a view similar to FIG. 1 of a prior art ice making machine.
Figure 4:
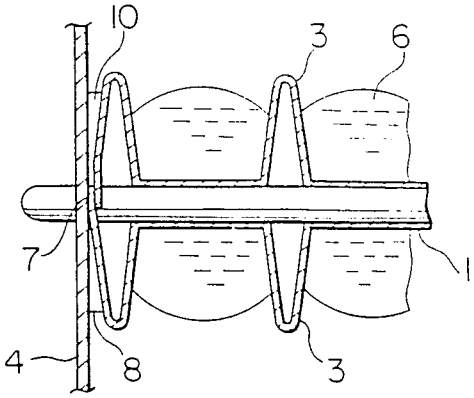
FIG. 4 (PRIOR ART)
FIG. 4 is a fragmentary sectional view taken along the line IV—IV in FIG. 3.

Referring to FIGS. 1 and 2, there is illustrated an ice making machine, constructed according to the invention, including a pair of ice forming plates 1, each of which is may preferably made of stainless steel exhibiting poor thermal conductivity as compared the copper or like material. The ice forming plates 1 are disposed substantially vertically with respective rear or inner surfaces 1*a* facing each other, wherein an evaporator 2 is interposed between the pair ice forming plates 1 in contact therewith. The evaporator 2 is composed of a meandering pipe which extends transversely or horizontally in a zig-zag pattern having a plurality of bends while contacting both of the inner surfaces 1*a* of the ice forming plates 1, as will be seen in FIG. 1. Usually, the coolant flows through the evaporator pipe 2 i the direction indicated by the arrows. Each of the ice forming plates 1 has an outer surface 1*b* with a plurality of partitions formed by convex protrusions 3, each having a substantially V-shaped cross-section and extending vertically while being spaced from one another in the horizontal direction, whereby a number of ice forming regions are defined between adjacent ones of the protrusions 3. As can best be seen in FIG. 2, each of the protrusions has a width decreasing progressively as the distance from the outer surface 1*b* of the ice forming plate 1 is increased.

In the preferred embodiment of the invention, the ice forming plate 1 has ends terminating at base portions 3*a* of the leftmost and rightmost V-shaped protrusion 3. More specifically, the lateral ends of the paired ice forming plates 1 are delimited by the overlapped base portions 3*a* of the V-shaped protrusions 3 located outermost as viewed in FIGS. 1 and 2, wherein the overlapped base portions 3*a* are fixedly connected together by welding or other suitable means. For supporting the pair of ice forming plates 1 on a frame (not shown) of the ice making machine in a manner known per se, a pair of plate-like brackets 4 are secured to both the frame and the ice forming plates 1. The brackets 4 are disposed in the vicinity of the lateral ends of the ice forming plates 1 and fixedly mounted to the outermost base portions 3*a* thereof, such as by welding or bending. By securing the brackets 4 to the ice forming plates 1 in this manner, V-shaped grooves or gaps 10 are formed between the brackets 4 and the ice forming plates 1 at the lateral ends thereof, as can be best seen in FIG. 2.

Disposed above the ice forming plates 1 is a water distributor pipe 9 for supplying deicing water, which is mounted so as to extend transversely through the brackets 4. The water distributor 9 is formed with a plurality of deicing water spray nozzle orifices 5 arranged in a horizontal row in spaced relationship with each other and so oriented as to direct the deicing water discharged therefrom into the space defined between the inner surfaces of the paired ice forming plates 1. Further, two auxiliary water spray orifices 11 are provided in the water distributor 9 on the left and right sides thereof, respectively, to thereby direct the deicing water to the base portions 3*a* of the V-shaped protrusions 3 so that the associated connected portions of the ice forming plates 1 and the brackets 4 can be sprayed with the deicing water as well. It should be noted that the ice making machine is provided with another water distributor (not shown) well known in the art for supplying the ice forming water (i.e. water to be frozen for forming ice.

Next, the operation of the ice making machine will be described. In the ice forming mode, water is fed from the ice forming water distributor (not shown) onto the outer surfaces 1*b* of the ice forming plates 1, flows downwardly over the ice forming regions defined on the outer surfaces 1*b* of the ice forming plates 1, while the coolant is forced through the meandering pipe 2 in the direction indicated by the arrows, after having passed through a condenser, an expansion valve and other valve (not shown). Consequently, the ice forming water is cooled each time it flows across the straight pipe portions of the meandering pipe 2 in the course of flowing down the outer surfaces 1*b*, resulting in ice pellets 6, each of substantially arcuate cross-section, growing on the ice forming regions of the outer surfaces 1*b* of the ice forming plates 1 at locations where the straight pipe sections of the evaporator 2 are positioned on the inner surfaces of the plates 1. As the ice pellets 6 grow to such a size that the ice forming water flowing downwardly over the ice pellets 6 in the outermost regions will migrate beyond the outermost protrusions 3 into the V-grooves or gaps 10 located outside of the outermost ice forming regions, the water is also frozen within the grooves 10.

When the ice pellet 6 has grown to a predetermined size, this is detected directly or indirectly by a known detector, whereupon the ice making machine is changed over to an ice removing mode from the ice forming mode. Thus, the meandering pipe 2 is preferably supplied with a hot gas, while the ice forming water supply is stopped, which is followed by the deicing water being supplied to the ice forming plates 1. More specifically, the deicing water is distributed over the inner surfaces 1*a* of the ice forming plates 1 through water spraying orifices 5 to melt the portions of the ice pellets 6 which are in contact with the outer surfaces 1*b* of the ice forming plates 1, allowing the ice pellets 6 to be removed from the ice forming plates 1 and to fall into an ice storage box (not shown). The deicing water is additionally supplied between the plates to the junctions (interconnected portion) between the ice forming plates 1 and the brackets 4 from the auxiliary water spray orifices 11 for the purpose of removing the unwanted ice formed in the grooves 10. In this manner, it can be ensured that no ice pellets remain on the ice forming plates when the succeeding ice forming operation is started.

Guide plates may preferably be provided at both left and right lower ends of the ice forming plates 1 or the brackets 4, respectively, for guiding the ice refuse removed from the grooves 10 to a place other than the ice storage box. In connection with the illustrated embodiment, it has been described that the deicing water is directed to the junction between the bracket 4 and the ice forming plate 1 from the associated auxiliary water spray orifice 11. It should however be appreciated that the auxiliary water spray orifice 11 may be so oriented that the deicing water can directly impinge on the ice within the groove 10 or both the junction and the ice refuse.

It is thought that the invention and many of its attendant advantages will be understood from the foregoing description and it will be apparent that various changes may be made in the form, construction and arrangement thereof without departing from the spirit and scope of the invention or sacrificing all of its material advantages, the form described being merely a preferred or exemplary embodiment thereof.

We claim as our invention:

1. An ice making machine, comprising:

a first ice forming plate having a front surface and a rear surface, said first plate being disposed substantially vertically and including a plurality of partition means, said partition means extending substantially vertically and being laterally spaced to thereby define ice forming regions on said front face between adjacent ones of said partition means;

an evaporator in contact with at least portions of said rear surface of said first plate;

a first support member connected to a lateral end of said first plate and a second support member connected to a second lateral end of said first plate; and deicing water supply means disposed near a top end of said first plate and including a plurality of spraying orifices arranged in a laterally extending row for supplying deicing water to said first plate, and at least one auxiliary spraying orifice laterally spaced from each end of said row toward an associated one of said lateral ends of said first plate for supplying water to remove ice produced in areas between said support members and said ice forming regions.

2. A machine as in claim 1, wherein each of said partition means is substantially V-shaped in horizontal cross-section with the base of the V integrally connected to said first plate and the apex of the V extending away from said evaporator, both of said lateral ends of said first plate including a laterally exterior one of said partition means with the laterally exterior base portion of the V connected to the respective said support member to thereby define a substantially V-shaped groove between said laterally exterior partition means and the respective said support member, said grooves constituting said areas.

3. A machine as in claim 2, wherein said auxiliary spraying orifices are oriented to supply deicing water to said rear surface of said first plate at the connections of said laterally exterior partition means and said support members.

4. A machine as in claim 2, wherein said auxiliary spraying orifices are oriented to supply deicing water to said grooves.

5. A machine as in claim 2, wherein said auxiliary spraying orifices are oriented to supply deicing water to said grooves and to said rear surface of said first plate at the connections of said laterally exterior partition means and said support members.

6. A machine as claimed in claim 2, further comprising a second ice forming plate, said second plate is substantially identical to said first plate and is vertically disposed with said evaporator in contact with at least portions of a rear surface of said second plate and the apex of each of a plurality of V-shaped partition means extending away from said evaporator, both lateral ends of said second plate including a laterally exterior one of said partition means with the laterally exterior base portion of the V connected to the respective said support member, said spraying orifices supply deicing water to said first and said second plates, and said auxiliary spraying orifices are oriented to supply deicing water to said rear surfaces of said first and said second plate at the connections of said laterally exterior partition means and said support members.

* * * * *